US006343824B1

(12) United States Patent
Foy

(10) Patent No.: US 6,343,824 B1
(45) Date of Patent: Feb. 5, 2002

(54) APPARATUS FOR SUSPENDING A LOAD

(76) Inventor: Peter Stuart Foy, c/o Foy Inventerprises, Inc 3275 E. Patrick La., Las Vegas, NV (US) 89120

( * ) Notice: Subject to any disclaimer, the term of this patent is extended or adjusted under 35 U.S.C. 154(b) by 0 days.

(21) Appl. No.: 09/022,190

(22) Filed: Feb. 11, 1998

(51) Int. Cl.[7] ..... B64D 17/38

(52) U.S. Cl. ..... 294/82.35; 294/82.25; 24/573.5; 24/657

(58) Field of Search ..... 294/82.24, 82.25, 294/82.35, 82.36, 140; 24/651, 656, 657, 658, 573.1, 573.5, 630, 634

(56) References Cited

U.S. PATENT DOCUMENTS

| | | | | | |
|---|---|---|---|---|---|
| 2,439,613 | A | * | 4/1948 | Quilter | 294/82.25 |
| 2,489,864 | A | * | 11/1949 | Cravener | 294/82.35 |
| 2,629,156 | A | * | 2/1953 | Kamens et al. | 24/657 |
| 2,857,123 | A | * | 10/1958 | Martin | 294/82.25 |
| 4,587,695 | A | | 5/1986 | Jensen | 24/634 |
| 4,687,236 | A | * | 8/1987 | Rasche | 24/657 |
| 4,724,587 | A | * | 2/1988 | Foy | 24/656 |
| 4,740,020 | A | * | 4/1988 | Williams | 24/657 |
| 5,659,931 | A | * | 8/1997 | Anscher | 24/573.1 |
| 5,688,012 | A | * | 11/1997 | Siesjo et al. | 294/82.24 |
| 5,907,892 | A | * | 6/1999 | Todd | 24/567 |
| 6,151,754 | A | * | 11/2000 | Chen | 24/657 |

FOREIGN PATENT DOCUMENTS

| | | | |
|---|---|---|---|
| FR | 0472995 | * 12/1914 | 24/657 |
| GB | 861465 | 6/1959 | |
| GB | 1448526 | 12/1974 | |
| GB | 1528750 | 10/1978 | |
| GB | 2182094 A | 10/1986 | |

* cited by examiner

*Primary Examiner*—Eileen D. Lillis
*Assistant Examiner*—Paul T. Chin
(74) *Attorney, Agent, or Firm*—Biebel & French

(57) ABSTRACT

Apparatus for suspending a load, in particular a person, from a cable comprises a harness plate adapted to be secured to a harness for supporting the person. The harness plate includes a locking mechanism comprising two locking members spaced apart to define a through-aperture, resilient members arranged to resiliently bias the locking members towards each other to substantially close the through-aperture, and user-operable finger grips arranged to move the locking members against the resilient bias. The apparatus also includes a cable spade having a first part adapted to be attached to the cable and a second part shaped for insertion into the through-aperture and retention therein by the locking members. Insertion of the spade into the through-aperture initially moves the locking members apart against the resilient bias to open the through-aperture and then permits the resilient members to return the locking members so as to securely retain the cable spade in the through-aperture. The cable spade is releasable from the through-aperture by the user-operable fingergrips.

12 Claims, 5 Drawing Sheets

APPARATUS FOR SUSPENDING A LOAD

FIELD OF THE INVENTION

This invention relates to apparatus for suspending a load, in particular a harnessed person or article, from a suspension wire or cable and is more particularly, but not exclusively, concerned with such apparatus for use in theatrical or stage work where a person needs to be suspended, for example, in theatrical "flying".

BACKGROUND OF THE INVENTION

It is known to suspend performers from overhead wires or cables by means of a shoulder or body harness shackled to the end of a support wire or cable. Such known flying equipment has the capability to rotate a person through 180° or more, to move a person around a stage area and to lift and lower the person. A harness plate for this purpose is disclosed in U.S. Pat. No. 4,724,587 to Foy, and is intended to be securely attached to a harness. The harness plate comprises a toroidal passage open at one end facing an upper edge of the plate, a shackle staple having a pair of upwardly extending arms with opposed apertures, and a toroidal shackle pin resiliently mounted by a compression spring in the passage and biased such that the free end of the pin passes through the arm apertures. A finger-like projection on the pin is operated to retract the pin into the passage against the action of the spring and to allow the eye of a suspension cable to be positioned between the arms. When the pin is released, its free end passes through the eye and thereby secures the harness plate to the cable. In order to remove the harness plate from the cable, the pin is again retracted against the action of the spring. However, this method of attaching and detaching the cable may not be particularly easy to carry out quickly and unobtrusively by the performer during an on-stage performance.

It is therefore an object of the present invention to provide an improved apparatus for suspending a load, in particular a person, which enables quick and discreet attachment and detachment of the suspension cable.

SUMMARY OF THE INVENTION

According to the invention there is provided apparatus for suspending a load, in particular a person, from a cable, said apparatus comprising:

a harness plate adapted to be secured to a harness for supporting said load, said harness plate including a locking mechanism comprising at least one locking member, a through-aperture defined by said at least one locking member, resilient means arranged to resiliently bias said at least one locking member to substantially close said through-aperture, and user-operable means arranged to move said at least one locking member against the bias of said resilient means; and cable attachment means having a first part adapted to be attached to said cable and a second part shaped for insertion into said through-aperture and retention therein by said at least one locking member, whereby insertion of said second part initially moves said at least one locking member against the bias of said resilient means to open said through-aperture and then permits said resilient means to return said at least one locking member so as to securely retain said cable attachment means in said through-aperture, said cable attachment means being releasable from said through-aperture by said user-operable means.

In a preferred embodiment, the locking mechanism comprises two locking members adapted to move towards and away from each other and being spaced apart so as to form said through-aperture therebetween. The resilient means may be adapted to bias said locking members towards each other to substantially close said through-aperture and said user-operable means may be adapted to move said locking members apart against the bias of said resilient means. The locking members are preferably located on first and second sides of said through-aperture respectively, and the user-operable means may comprise slidable members connected to said locking members and extending outwardly with respect to said plate, the slidable member connected to the locking member on said first side extending outwardly on said second side and the slidable member connected to the locking member on said second side extending outwardly on said first side, such that sliding said slidable members towards each other causes said locking members to move away from each other and thereby to open said through-aperture.

The second part of said cable attachment means may have a substantially triangular head and a neck such that said head can be inserted through said through-aperture and said locking members are resiliently biased to engage against said neck to securely retain said cable attachment means.

Preferably, the harness plate has a rotationally symmetrical shape and is adapted to be rotatably mounted on a harness, and means are provided to inhibit rotation of said plate unless said cable-attachment means are inserted through said through-aperture. The means to inhibit rotation may comprise a stop member including resilient means biased to inhibit said rotation, said cable attachment means being adapted to move said stop member against the bias of said resilient means to release said plate for rotation.

In one example, two of said locking mechanisms are provided on opposite sides of said harness plate, such that two loads can be suspended one above the other.

BRIEF DESCRIPTION OF THE DRAWINGS

The invention will now be described, by way of example, with reference to the accompanying drawings, in which:

FIG. 4*b* shows a schematic sectional view through IV—IV in FIG. 4*a.

DETAILED DESCRIPTION OF THE PREFERRED EMBODIMENTS

Figure 1:
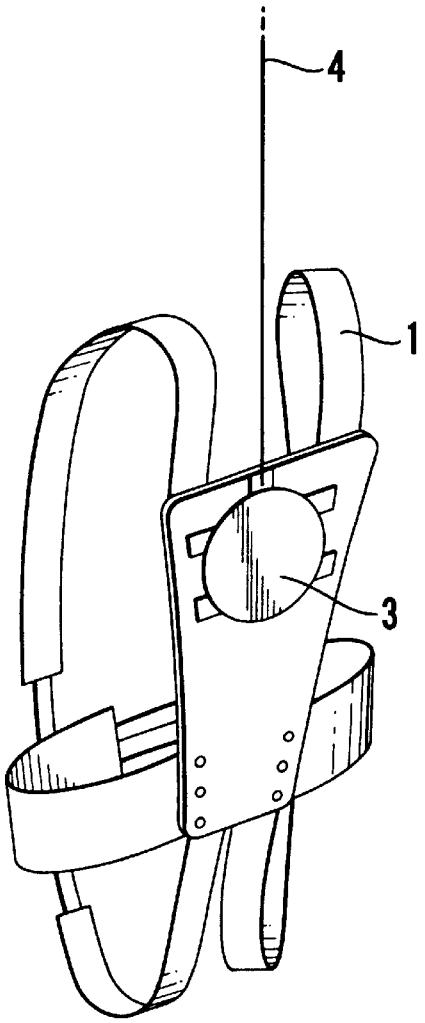
FIG. 1 shows a schematic perspective view of a harness incorporating a harness plate in accordance with the invention.
Figure 2:
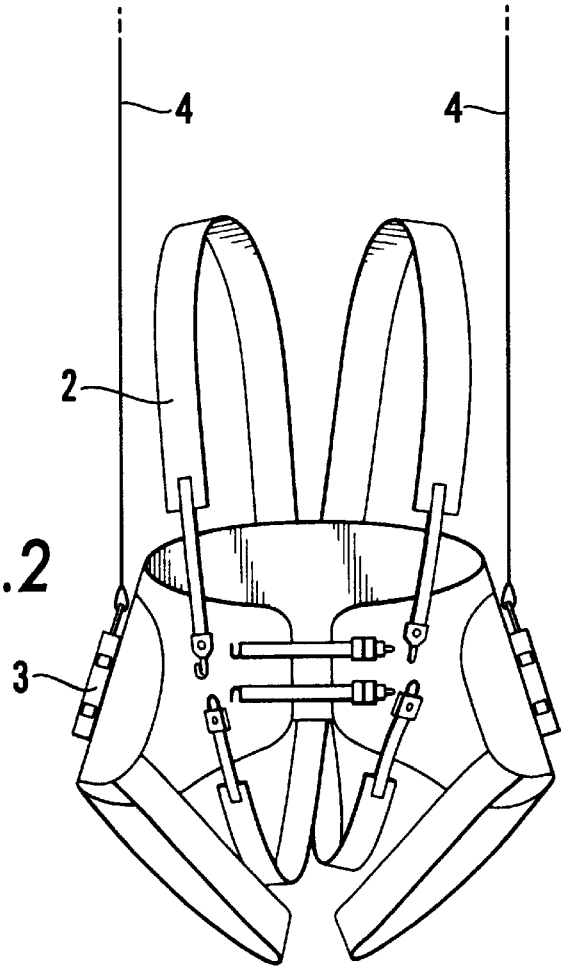
FIG. 2 shows a schematic front view of another harness incorporating two of said harness plates.

FIGS. 1 and 2 show two examples of a harness 1,2, to which apparatus 3, in accordance with the present invention, can be securely attached. Each harness 1,2 is intended to be fitted around a person (not shown) to be supported. In the first example, the harness 1 has one apparatus 3 attached to the back of the harness so that the harnessed person is supported by a single cable 4. In the second example, the harness 2 has an apparatus 3 on each side, so that the harnessed person is supported by two cables 4.

Figure 3A:
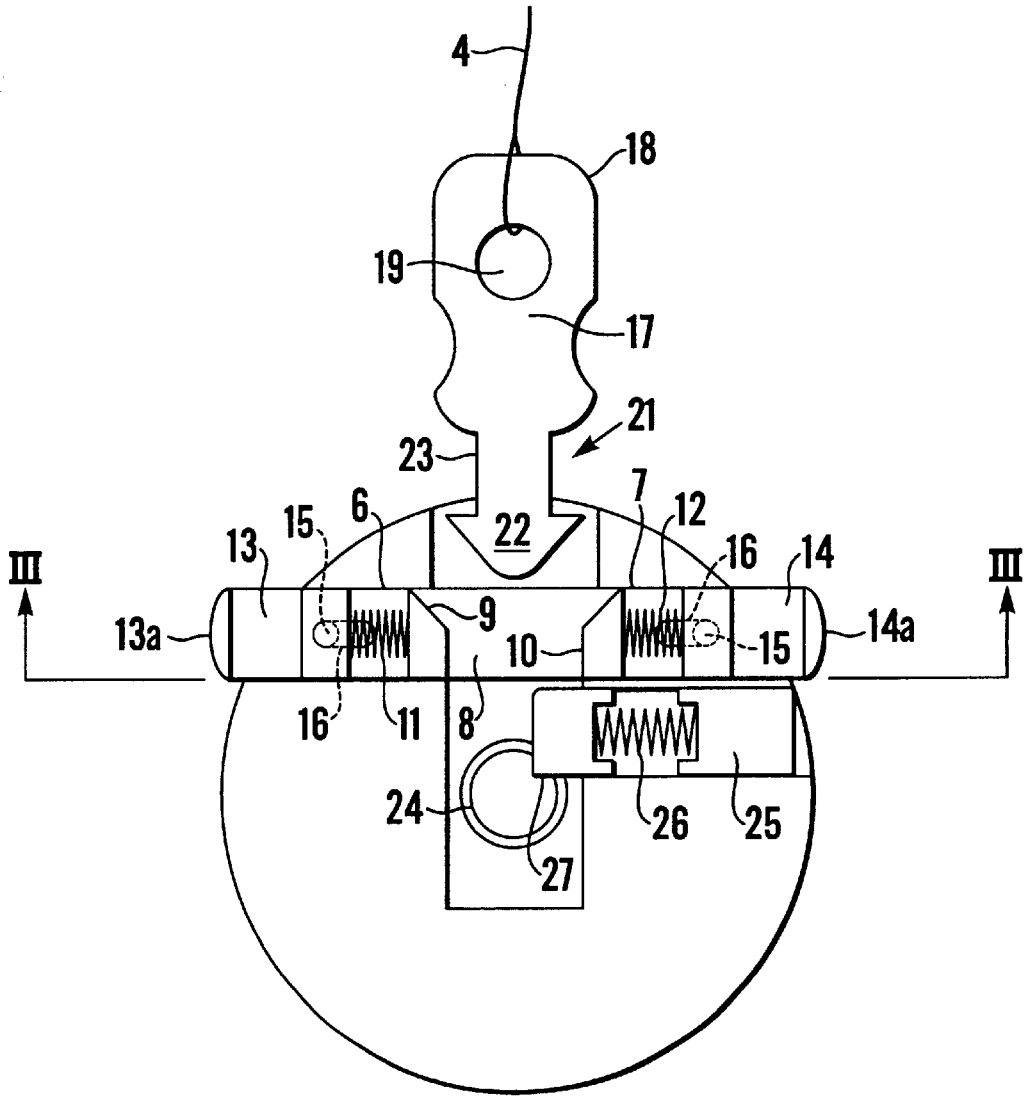
FIG. 3*a* shows a schematic view of one embodiment of the invention, in an unlatched or open state.

FIGS. 3 and 4 show a first embodiment of the apparatus 3, which is intended to suspend a single person. The apparatus 3 comprises a generally circular harness plate 5 upon which two locking members 6,7, forming a locking mechanism, are slidably mounted. Each locking member 6,7 is biassed by a compression spring 11,12 to substantially close a through-aperture 8 formed between inner ends 9,10 of the locking members 6,7. The locking members 6,7 are connected to slides 13,14, respectively, the outer ends 13*a*, 14*a* of which may be formed with finger grips to enable the slides to be squeezed towards each other as described hereinbelow.

Figure 3B:
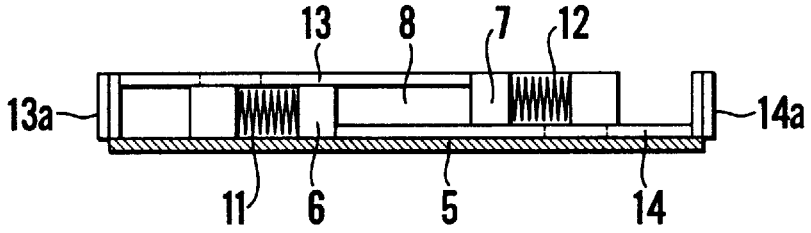
FIG. 3*b* shows a schematic sectional view through III—III in FIG. 3*a;*
Figure 4A:
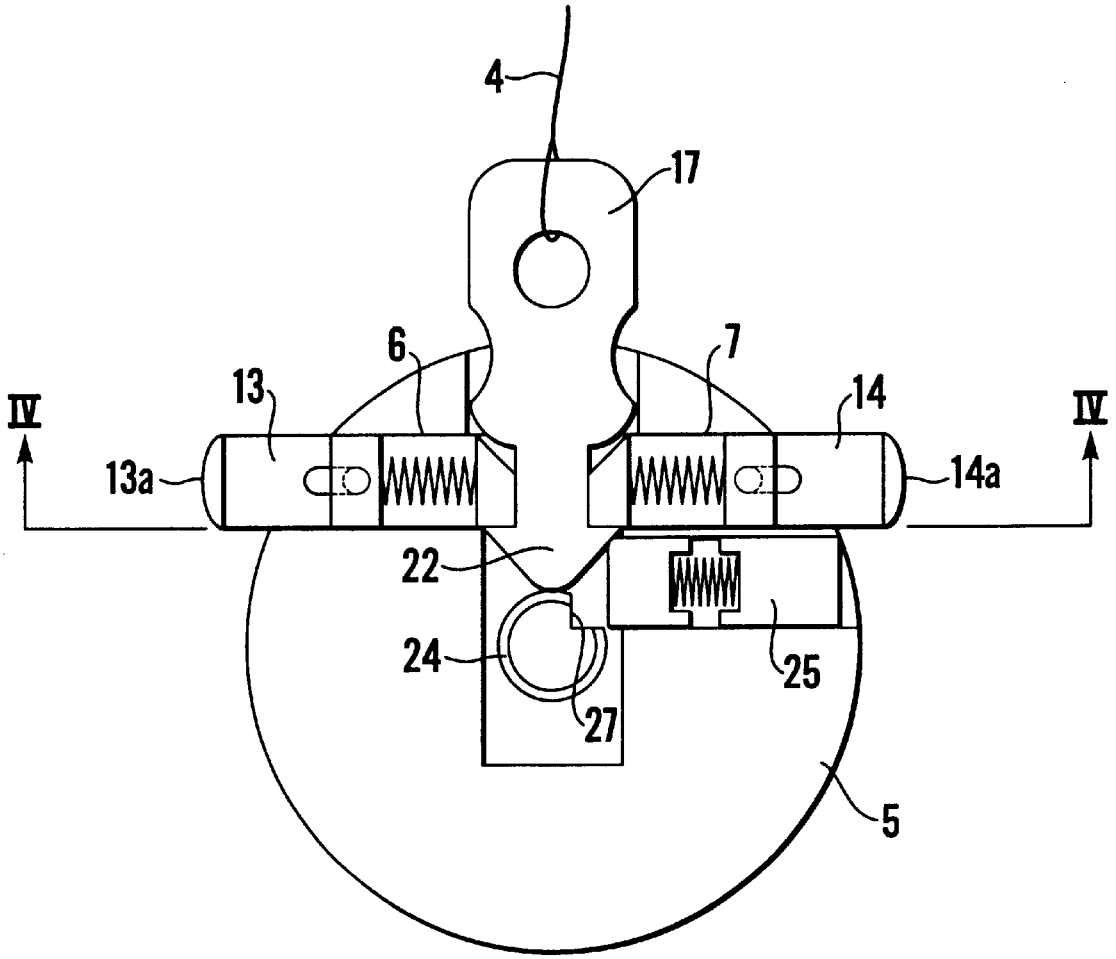
FIG. 4*a* shows a schematic view of the embodiment shown in FIG. 3*a,* but in a latched or closed state.
Figure 4B:
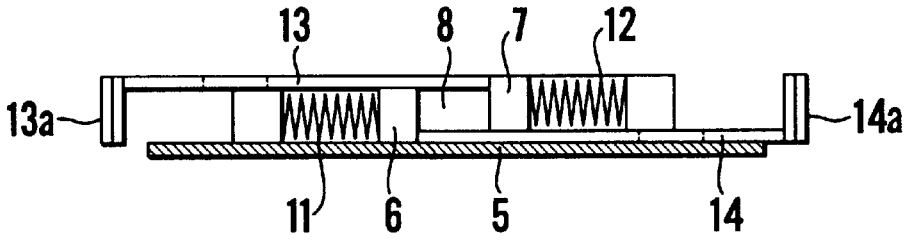

As can be seen from FIGS. 3*b* and 4*b*, the locking member 6 on one side of the through-aperture 8 is connected to the slide 14 extending outwardly on the other side of the through-aperture 8 and the locking member 7 is connected to the slide 13. Consequently, when the outer ends 13*a*,14*a* are pushed towards each other, the locking members 6,7 are pushed away from each other, the springs 11,12 are compressed, and the through-aperture 8 is opened, as shown in FIG. 3*b*. When the outer ends 13*a*,14*a* are released, the locking members 6,7 automatically move towards each other by the action of the springs 13,14 and thereby substantially close the through-aperture 8, as shown in FIG. 4*b*. The extent of movement of the locking members 6,7, and thus the extent to which the through-aperture 8 is opened and closed, is defined by a stop member 15 located in an aperture 16 formed in each locking member 6,7.

The inner ends 9,10 of the locking members 6,7 are shaped to receive a cable spade 17 comprising a first part 18 having an aperture 19 for attachment of the suspension cable 4, and a second part 21 for insertion into the through-aperture 8. The second part 21 has a generally triangular head 22, which is shaped to cooperate with the inner ends 9,10 of the locking members 6,7 and a neck 23, which is dimensioned to engage between the inner ends 9,10 when the through-aperture 8 is closed.

The harness plate 5 is intended to be rotatably mounted to the harness 1, 2 so that the harnessed person can perform somersault movements while suspended by the cable 4. To this end, the plate 5 can rotate about a central hub 24 and the plate includes a stop member 25 which is biassed by a compression spring 26 to locate in a notch 27 in the hub 24 whenever the cable spade 17 is not inserted through the through-aperture 8. This stop member 25 thus inhibits rotation of the plate 5 to facilitate insertion of the spade 17 into the through-aperture 8.

When the spade 17 is not inserted in the through-aperture 8, the locking members 6,7 are in the positions shown in FIGS. 4*a* and 4*b*, in which they are resiliently biassed towards substantially closing the through-aperture 8. When the spade 17 is required to be inserted into the through-aperture, the front end of the spade head 22 pushes against the inner ends 9,10 of the locking members 6,7 which causes the locking members 6,7 to move outwardly against the bias of the compression springs 11,12. Once the head 22 has passed through the through-aperture 8, the springs 11,12 cause the locking members 6,7 to return to their original positions, which causes the inner ends 9,10 of the locking members to engage around the neck 21 of the spade 17 and thereby securely retain the spade. It can be seen from FIG. 4*a* that, when the head 22 has passed through the through-aperture 8, its front end pushes the stop member 25 outwardly against the action of the spring 26, so that the stop member disengages from the notch 27 and thereby releases the plate 5 to enable it to rotate about the hub 24.

In order to release the cable spade 17 from the locking mechanism, the finger grips on the outer ends 13*a*,14*a* of the slides 13,14 are squeezed towards each other, which thus causes the locking members 6,7 to retract, as shown in FIG. 3*b*, and open the through-aperture 8. Removal of the spade 17 from the locking mechanism causes the stop member 25 to move, under the action of the spring 26, into engagement again with the notch 27 and thereby inhibit rotation of the plate 5. Once the spade 5 is removed and the outer ends 13*a*,14*a* have been released, the locking members 6,7 will return, by the action of the springs 11,12, to their original positions in which the through-aperture 8 is substantially closed.

Figure 5:
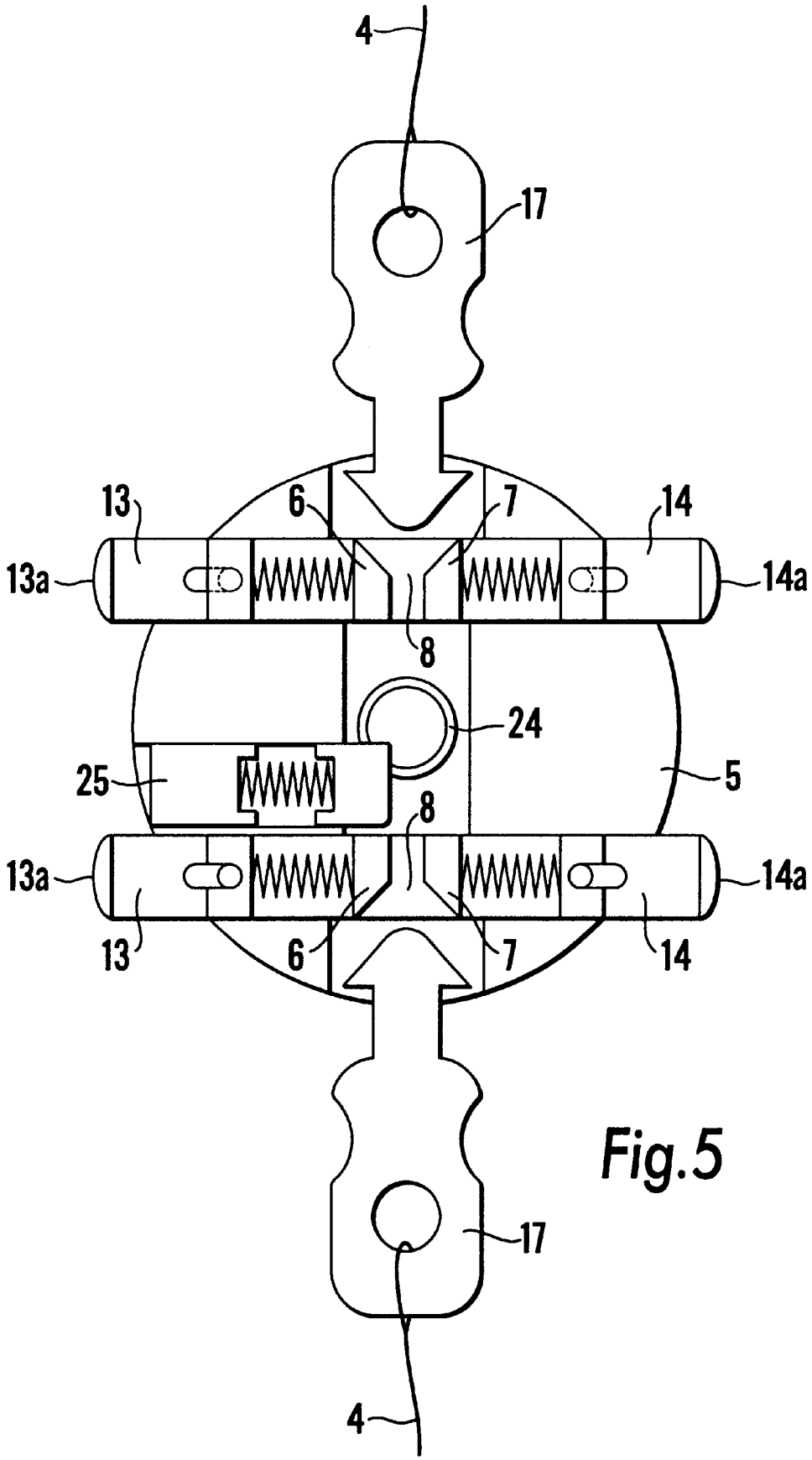
* and FIGS. 5 and 6 show schematic views of another embodiment of the invention in an unlatched and a latched state, respectively.
Figure 6:
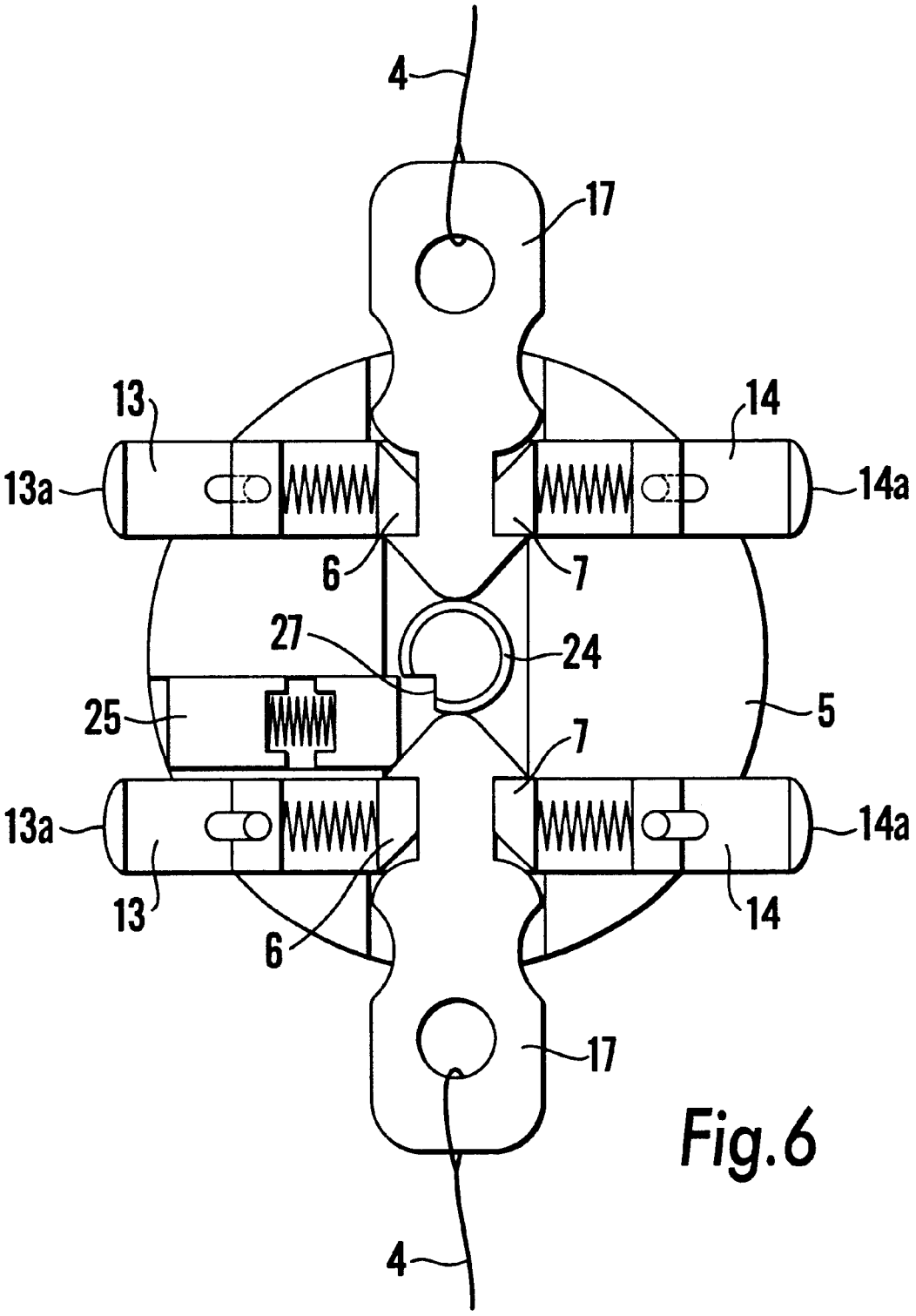

A second embodiment of the invention is shown in FIGS. 5 and 6, in which like parts are labelled with like reference numerals with respect to FIGS. 3 and 4. In this embodiment, the harness plate 5 is provided with two locking mechanisms, such that the two through-apertures 8 are radially aligned with each other. This arrangement therefore enables two persons to be supported by the same harness plate, with one person suspended below the other person. In this arrangement, the upper cable 4 is connected to an overhead support mechanism (not shown) and the lower cable 4 is connected to another harness plate (not shown) secured to the harness of the lower person. This embodiment is advantageous in that it enables two persons to perform complex maneuver and choreography together without any entangling of the cables. Clearly, this embodiment could be used by just one person if desired, in which case the cable spade would be inserted into the through-aperture 8 adjacent the stop member 26 if rotation of the plate 5 is required.

The present invention is advantageous in that it enables the cable spade to be quickly and discreetly inserted into the locking mechanism using a single hand and also enables single-handed release of the cable spade by squeezing together the locking members. Consequently, attachment and detachment of the cables can be more easily incorporated into the choreography of the performers in an unobtrusive manner.

Modifications may be made to the specific embodiments described above, as will be readily apparent to those skilled in the art, without departing from the invention as defined in the accompanying claims. For example, the harness plate is illustrated as generally circular. However, it could be any suitable shape, but is preferably rotationally symmetrical so that its rotation would be unobtrusive during its use on stage. Furthermore, in the second illustrated embodiment, a stop member to inhibit rotation of the harness plate may be located adjacent each through-aperture, instead of just one of the through-apertures.

What is claimed is:

1. Apparatus for suspending a load, in particular a person, from a cable, said apparatus comprising:

a harness plate adapted to be secured to a harness for supporting said load, said harness plate including a locking mechanism comprising at least one locking member, a through-aperture defined by said at least one locking member, resilient means arranged to resiliently bias said at least one locking member to substantially close said through-aperture, and user-operable means arranged to move said at least one locking member against the bias of said resilient means;

cable attachment means having a first part adapted to be attached to said cable and a second part shaped for insertion into said through-aperture and retention therein by said at least one locking member, whereby insertion of said second part initially moves said at least one locking member against the bias of said resilient means to open said through-aperture and then permits said resilient means to return said at least one locking member so as to securely retain said cable attachment in said through-aperture, said cable attachment means being releasable from said through-aperture by said user-operable means; and means for enabling relative rotation between the harness plate and the harness while said cable attachment means are inserted in said through-aperture.

2. Apparatus as claimed in claim 1, wherein said locking mechanism comprises two locking members adapted to move towards and away from each other and being spaced apart so as to form said through-aperture therebetween.

3. Apparatus as claimed in claim 2, wherein said resilient means are adapted to bias said locking members towards each other to substantially close said through-aperture and said user-operable means are adapted to move said locking members apart against the bias of said resilient means.

4. Apparatus as claimed in claim 3, wherein the locking members are located on first and second sides of said through-aperture respectively, and the user-operable means comprise slidable members connected to said locking members and extending outwardly with respect to said plate, the slidable member connected to the locking member on said first side extending outwardly on said second side and the slidable member connected to the locking member on said second side extending outwardly on said first side, such that sliding said slidable members towards each other causes said locking members to move away from each other and thereby to open said through-aperture.

5. Apparatus as claimed in claim 1, wherein said second part of said cable attachment means has a substantially triangular head and a neck such that said head can be pushed through said through-aperture, and said locking members are resiliently biased to engage against said neck to securely retain said cable attachment means.

6. Apparatus as claimed in claim 1, wherein said harness plate has a rotationally symmetrical shape.

7. Apparatus as claimed in claim 1, wherein two of said locking mechanisms are provided on opposite sides of said harness plate, such that two loads can be suspended one above the other.

8. Apparatus for suspending a load, in particular a person, from a cable, said apparatus comprising:

a harness plate adapted to be secured to a harness for supporting said load, said harness plate including a locking mechanism comprising at least one locking member, a through-aperture defined by said at least one locking member, resilient means arranged to resiliently bias said at lease one locking member, resilient means arranged to resiliently bias said at least one locking member to substantially close said through-aperture, and user-operable means arranged to move said at least one locking member against the bias of said resilient means;

cable attachment means having a first part adapted to be attached to said cable and a second part shaped for insertion into said through-aperture and retention therein by said at least one locking member, whereby insertion of said second part initially moves said at least one locking member against the bias of said resilient means to open said through-aperture and then permits said resilient means to return said at least one locking member so as to securely retain said cable attachment means in said through-aperture, said cable attachment means being releasable from said through-aperture by said user-operable means;

means for enabling relative rotation between said harness plate and said harness; and means to inhibit rotation of said plate unless said cable-attachment means are inserted in said through-aperture.

9. Apparatus as claimed in claim 8, wherein said means to inhibit rotation comprises a stop member resiliently biased to inhibit said rotation, said cable attachment means being adapted to move said stop member against the bias of said resilient means to release said plate for rotation.

10. Apparatus as claimed in claim 8, wherein two of said locking mechanisms are provided on opposite sides of said harness plate, such that two loads can be suspended one above the other.

11. Apparatus for suspending a load, in particular a person, from a cable, said apparatus comprising:

a harness for supporting said load;

a harness plate secured to said harness including a locking mechanism comprising at least one locking member, a through-aperture defined by said at least one locking member, resilient means arranged to resiliently bias said at least one locking member to substantially close said through-aperture, and user-operable means arranged to move said at least one locking member against the bias of said resilient means; cable attachment means having a first part adapted to be attached to said cable and a second part shaped for insertion into said through-aperture and retention therein by said at least one locking member; whereby insertion of said second part initially moves said at least one locking member so as to securely retain said cable attachment means in said through-aperture, said cable attachment means being releasable from said through-aperture by said user-operable means; and means for enabling relative rotation between the harness plate and the harness while said cable attachment means are inserted in said through-aperture.

12. Apparatus for suspending a load, in particular a person, from a cable, said apparatus comprising:

a harness for supporting said load;

a harness plate secured to said harness, said harness plate including a locking mechanism comprising at least one locking member, a through-aperture defined by said at least one locking member, resilient means arranged to resiliently bias said at lease one locking member to substantially close said through-aperture, and user-operable means arranged to move said at least one locking member against the bias of said resilient means;

cable attachment means having a first part adapted to be attached to said cable and a second part shaped for insertion into said through-aperture and retention therein by said at least one locking member, whereby insertion of said second part initially moves said at least one locking member against the bias of said resilient means to open said through-aperture and then permits said resilient means to return said at least one locking member so as to securely retain said cable attachment means in said through-aperture, said cable attachment means being releasable from said through-aperture by said user-operable means;

means for enabling relative rotation between said harness plate and said harness; and means to inhibit rotation of said plate unless said cable-attachment means are inserted in said through-aperture.

* * * * *